United States Patent [19]

Michalik

[11] Patent Number: 4,648,586

[45] Date of Patent: Mar. 10, 1987

[54] GEAR FOLDER

[75] Inventor: Horst B. Michalik, Höchberg, Fed. Rep. of Germany

[73] Assignee: Koenig & Bauer Aktiengesellschaft, Fed. Rep. of Germany

[21] Appl. No.: 810,141

[22] Filed: Dec. 18, 1985

[30] Foreign Application Priority Data

Oct. 31, 1985 [DE] Fed. Rep. of Germany ..... 3538799
Dec. 12, 1985 [DE] Fed. Rep. of Germany ..... 3543868

[51] Int. Cl.[4] ..... B42C 1/04

[52] U.S. Cl. ..... 270/50; 270/42; 493/366

[58] Field of Search ..... 270/50, 53, 42, 43, 270/21.1, 47, 6; 493/397, 398, 399, 366–368, 370, 424

[56] References Cited

U.S. PATENT DOCUMENTS

| | | | |
|---|---|---|---|
| 2,706,628 | 4/1955 | Huck | 270/43 X |
| 2,981,540 | 4/1958 | Harless | 270/50 X |
| 3,263,988 | 8/1966 | Heimlicher | 270/50 |
| 3,348,837 | 10/1967 | Schunemann | 270/50 X |
| 3,540,723 | 11/1970 | Schunemann | 270/50 X |
| 3,544,454 | 12/1970 | Muth et al. | 270/43 X |
| 4,123,048 | 10/1978 | Weschenfelder et al. | 270/42 X |
| 4,190,242 | 10/1977 | Bolza-Schunemann | 270/50 |
| 4,279,410 | 7/1981 | Bolza-Schunemann | 270/50 X |
| 4,368,879 | 1/1983 | Hoshi | 270/6 |
| 4,380,449 | 6/1981 | Michalik | 493/424 |
| 4,437,855 | 3/1984 | Bullen | 270/50 |
| 4,491,310 | 1/1985 | Reffert | 270/50 X |
| 4,496,338 | 5/1983 | Michalik | 493/367 |

*Primary Examiner*—E. H. Eickholt
*Attorney, Agent, or Firm*—Jones, Tullar & Cooper

[57] ABSTRACT

A gear folder for paper web ribbons utilizes four cooperating cylinders. The paper web is delivered between a cutting cylinder and a pin-holing and grooved bar cylinder where one or more cutting knives sever the web into signatures. The signatures are taken from the pin-holing cylinder by a collecting cylinder that is equipped with controllable pin sets. This collecting cylinder is operable in either straight, collect or double collect production. A bipartite folding blade cylinder, which has a slotted outer casing and a plurality of gear driven folding blades, receives the signatures from the collecting cylinder and causes them to be folded between opposed driven folding rollers. A section stitcher is cooperatively positioned adjacent the pin-holing and grooved bar cylinder.

5 Claims, 1 Drawing Figure

GEAR FOLDER

FIELD OF THE INVENTION

The present invention is directed generally to a gear folder. More particularly, the present invention is directed to a gear folder for a web fed printing machine. Most specifically, the present invention is directed to a gear folder having four cooperating cylinders. A cutting cylinder having one or two cutting blades severs a printed web through cooperation with a pin-holing and grooved bar cylinder. The severed signatures are then taken over by a collecting cylinder which can operate in straight, collect, or double collect production. The collected signatures from the collecting cylinder are delivered to a folding blade cylinder which cooperates with spaced folding rollers. The folded signatures are directed to a delivery fan and are transferred away from the gear folder of the present invention.

DESCRIPTION OF THE PRIOR ART

Gear folder assemblies for use with printing apparatus are generally known in the prior art and are available in numerous design forms. Several exemplary gear folders may be seen in U.S. Pat. Nos. 4,123,048 and 4,190,242, both of which are assigned to the assignee of the present application.

In many of these prior art gear folding assemblies, there are provided three cylinders or cylinder sets which perform the cutting, collecting and folding functions. A drawback of gear folders of this prior type is that the cutting and collecting forces both act on the same cylinder. Thus paper web ribbon tension can be affected by the collecting process or by the formation of thick folded products.

In many of the prior art gear folders in which the collecting cylinder and folding blade assembly are combined into one cylinder, relatively complex means are required to control the timing of the passage of the folding blades through the periphery of the cylinder. This is necessary when the collecting cylinder is switched between straight, collect, and double collect production. Such combination folding blade and collecting cylinder assemblies are apt to be quite complex and costly. Furthermore, there is a limit to the size of the folding blades which can be used in cylinders of this type because these blades must be rotated and cannot have too great a weight. This effectively limits the length of the folding blade which can protrude from the cylinder and thus limits the diameters of the folding rollers that cooperate with the collecting and folding blade cylinders of the prior art. Small diameter folding rollers must exert a relatively large folding force on the products and this is apt to lead to signature damage. The prior art gear folders are apt to be complex, expensive assemblies in which the cutting and folding forces act on the same cylinder and in which paper web ribbon tension is influenced by the gear folder. Further, the prior art gear folders are not able to use long folding blades and thus require small diameter folding rollers which exert large folding forces on the signatures being folded.

SUMMARY OF THE INVENTION

It is an object of the present invention to provide a gear folder.

Another object of the present invention is to provide a gear folder for a paper web.

A further object of the present invention is to provide a gear folder having separate collecting and folding blade cylinders.

Yet another object of the present invention is to provide a gear folder in which the cutting and folding forces act on different cylinders.

Still a further object of the present invention is to provide a gear folder in which the collecting operation does not influence web tension.

Even still another object of the present invention is to provide a gear folder having long folding blades.

As will be discussed in greater detail in the description of the preferred embodiment which is set forth subsequently, the gear folder in accordance with the present invention utilizes an arrangement of four cooperating cylinders to cut, collect and fold paper webs which typically are delivered from a web fed rotary printing apparatus. The four cylinders include a cutting blade cylinder having one, and preferably two cutting blades; a pin-holing and grooved bar cylinder; a collecting cylinder having at least three controllable pin sets; and a folding blade cylinder having at least two, and preferably three gear folding blades.

In the gear folder of the present invention cutting and folding forces do not act on the same cylinder. Further, the tension exerted on the paper web ribbon is not influenced by collecting processes or by the production of thick folded products. Thus there is less apt to be any paper web breakage or tearing.

The folding blade cylinder is separate from the collecting cylinder. This means that the folding blades themselves do not have to be arranged on a separate folding blade carrier which is rotatable within a gripper and pin-holing cylinder. These folding blades can be supported inside plates which are securely attached to the cylinder shaft. When the gear folder of the present invention operates in collect production, since there is a separate collecting cylinder, it is not necessary to set aside or disable selected ones of the folding blades, as was required in prior art devices. This results in a less complex assembly which is more reliable than prior devices and requires much less complicated gear trains and associated mechanisms.

The cutting blade cylinder, which is provided with preferably two cutting blades, has the blades locatable so that signatures of varying lengths may be produced. This facilitates the formation of a finished folded product in which the inner folded signatures are shorter than the outer folded signatures and hence do not project further than do the outer ones. It is also possible to use a section stitcher with the gear folder of the present invention.

The gear folder in accordance with the present invention is less complex than prior art devices. It does not adversely influence paper web ribbon tension, and separates the cutting and folding forces onto separate cylinders. The folder is efficient, durable and usable in a wide variety of situations.

BRIEF DESCRIPTION OF THE DRAWING

While the novel features of the fear folder in accordance with the present invention are set forth with particularity in the appended claims, a full and complete understanding of the invention may be had by referring to the detailed description of the preferred embodiment which is set forth subsequently, and as is illustrated in the accompanying sole drawing FIGURE which is a schematic side elevation view of a gear folder in accordance with the present invention with the front side frame removed for clarity.

DESCRIPTION OF THE PREFERRED EMBODIMENT

Figure 1:
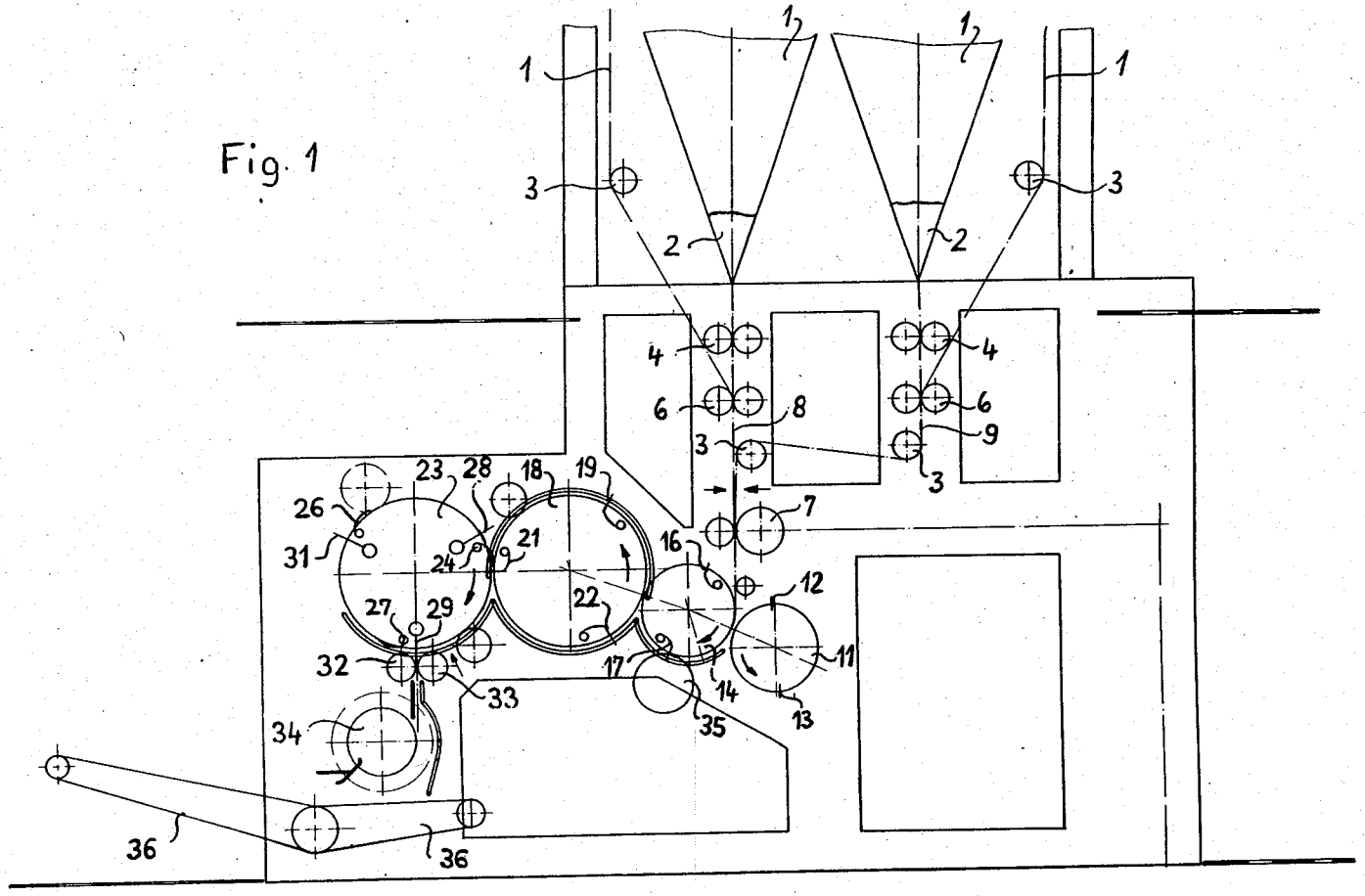

Referring now to the sole drawing FIGURE, there may be seen a plurality of paper webs 1 which may either be folded by longitudinal fold formers 2, or which may pass by lead rollers 3 located adjacent the longitudinal fold formers 2 after having been longitudinally slit and brought together by turning bars (not shown). These part width paper web ribbons 8 and 9 are then directed by, and between a plurality of drag roller 4, 6, and 7 which may be driven either mechanically or electrically. After the paper web ribbons 8, 9 pass by drag roller 7, they are run between a cutting cylinder 11 and a cooperating pin-holing and grooved bar cylinder 14. Cutting cylinder may be, in the preferred embodiment, a ½ or preferably a 2/2 cutting cylinder and is provided on its periphery with spaced cutting knives 12 and 13 which are generally opposite to each other. The positioning of the knives 12 and 13 can be varied slightly about the periphery of cutting cylinder 11 so that in collect production, for example, the lengths of successively cut signatures can be varied thereby allowing a folded product in which the inner folded signatures do not project out beyond the outer ones. In double production, the cutting knives 12 and 13 lie in the plane along the diameter of the cutting cylinder 11.

Pin-holing and grooved bar cylinder 14, with which cutting cylinder cooperates is, in the preferred embodiment, a 2/2 cylinder and is provided with two controllable sets of pins 16 and 17, and with two counter-cut grooved bars. The number of pin sets 16 and 17, the number of grooved bars, and the number of cutting knives 12 and 13 on cylinder 11 are all disclosed as being two. These numbers could be increased as whole number multiples of two, if desired. Pin-holing and grooved bar cylinder 14 is structured so that its cylinder diameter and hence peripheral size can be enlarged or reduced automatically. This can be accomplished in one of a number of known manners, such as is shown in U.S. Pat. Nos. 4,380,449 and 4,496,338 assigned to the assignee of the present application. This ability to vary peripheral size enables an adjustment and consistency of ribbon tension to be achieved.

A collecting cylinder 18 cooperates with pin-holing and grooved bar cylinder 14. Collecting cylinder 18 has, in the preferred embodiment, three controllable sets of pins 19, 21, and 22 which are arranged at equal, spaced intervals about the periphery of collecting cylinder 18. These pins 19, 21, and 22 cooperate with the pin-holing and grooved bar cylinder 14. The diameter of collecting cylinder 18 may be greater than that of pin-holing and grooved bar cylinder 14. Further, the circumferential speed of collecting cylinder 18 may be greater than the ribbon speed of the paper web ribbons 8 and 9 entering the gear folder. Collecting cylinder 18 is operable in straight, collect, and double collect production to secure cut signatures from pin-holing cylinder 14 and to hold and release the signatures by appropriate control of pin sets 19,21 and 22 in a known manner.

Signatures are delivered from the collecting cylinder 18 to a bipartite folding blade cylinder 23 which is formed having an outer casing and an inner folding blade carrier (not specifically shown). Three controllable gripper sets 24, 26, and 27 are positioned on the casing of folding blade cylinder 23, in the preferred embodiment, and are equally spaced from each other. Three generally well known gear driven folding blades 28, 29, and 31 are supported by the folding blade carrier. This carrier is supported by, and rigidly secured to the drive shaft for folding blade cylinder 23. The center of the drive shafts for the three gear folding blades 28, 29, and 31 run about a circle whose center lies on the center of the drive shaft for the folding blade cylinder 23. These gear folding blades 28, 29, and 31 each rotate beneath a slot in the outer casing of folding blade cylinder 23 so that, in a generally known manner, each folding blade 28, 29, and 31 periodically extends through its cooperating slot in the outer casing of folding blade cylinder 23 to force the center of a signature between a pair of spaced, driven folding rollers 32 and 33. As was previously mentioned, since folding blade cylinder 23 does not perform a collecting function but instead takes over signatures previously collected on collecting cylinder 18, it is not necessary that each of the folding blades 28, 29, and 31 be periodically disabled. This makes the assembly much less complex. Variations in thickness of the signatures to be folded can be accommodated by adjusting the extent to which each of the folding blades 28, 29, and 31 extends outwardly beyond the outer slotted casing of folding blade cylinder 23. This can be accomplished in a generally conventional manner by movement of a drive gear inwardly or outwardly.

The folding rollers 32 and 33 cooperate with the folding blades 28, 29, and 31 of the folding cylinder 23 and receive the signatures which are pushed between folding rollers 32 and 33 by successive ones of the folding blades 28, 29, and 31. These folding rollers 32 and 33 cooperate to fully fold the signatures which are then delivered to a delivery fan 34 and from there to a plurality of delivery tapes 36 which take the folded products away.

A generally well known section stitcher 35 may be positioned generally beneath pin-holing and grooved bar cylinder 14 and operates together with this cylinder in a generally conventional manner.

While a preferred embodiment of a gear folder in accordance with the present invention has been fully and completely set forth hereinabove, it will be apparent to one of skill in the art that a number of changes in the gear folder in accordance with the present invention may be made. For example, controllable pin sets may be substituted for gripper sets 24, 26, and 27 of folding blade cylinder 23. The invention is also not limited to the use of 2/2 cutting and pin-holing and grooved bar cylinders 11 and 14, respectively nor to a folding blade cylinder 23 with three gripper sets and three folding blades 28, 29, and 31. As indicated previously, a ½ cutting cylinder 11 having only one knife 12, and a folding blade cylinder 23 with two gear folding blades may also be used. Collecting cylinder 18 could also be, for example, a 5/2 cylinder. Since these and other changes to the gear folder of the present invention could be made without departing from the true spirit and scope of the invention, it is to be limited only by the following claims.

I claim:

1. A gear folder for folding paper webs, said gear folder comprising:

a cutting cylinder having at least one cutting knife positioned on a peripheral portion of said cutting cylinder;

a pin-holing and grooved bar cylinder cooperating with said cutting cylinder, said pin-holing and grooved bar cylinder having at least two controllable pin sets;

a collecting cylinder cooperating with said pin-holing and grooved bar cylinder and receiving signatures severed from the paper web by said cutting cylinder and cooperating pin-holing and grooved bar cylinder, said collecting cylinder having at least three controllable pin sets;

a folding blade cylinder cooperating with said collecting cylinder and having at least two controllable sets of grippers and at least two gear folding blades, said folding blade cylinder receiving collected signatures from said collecting cylinder and delivering said signatures to a pair of folding rollers, said folding blades inserting said signatures between said folding rollers.

2. The gear folder of claim 1 wherein said cutting cylinder is a 2/2 cylinder having two spaced cutting knives, wherein said pin-holing and grooved bar cylinder is a 2/2 cylinder, wherein said folding blade cylinder has three controllable sets of grippers, and further wherein said folding blade cylinder has three gear folding blades.

3. The gear folder of claim 1 wherein the diameter of said pin-holing and grooved bar cylinder is adjustable in size.

4. The gear folder of claim 1 wherein the circumferential speed of said collecting cylinder is greater than the ribbon speed of the paper web entering said gear folder.

5. The gear folder of claim 1 wherein a section stitcher is in cooperation with said pin-holing and grooved bar cylinder.

* * * * *